US011279148B2

(12) United States Patent
Noda et al.

(10) Patent No.: US 11,279,148 B2
(45) Date of Patent: Mar. 22, 2022

(54) LIQUID DISCHARGE APPARATUS

(71) Applicant: BROTHER KOGYO KABUSHIKI KAISHA, Nagoya (JP)

(72) Inventors: Masahiro Noda, Ogaki (JP); Atsushi Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/205,349

(22) Filed: Mar. 18, 2021

(65) Prior Publication Data

US 2021/0300069 A1 Sep. 30, 2021

(30) Foreign Application Priority Data

Mar. 31, 2020 (JP) ..... JP2020-063240

(51) Int. Cl.
*B41J 11/00* (2006.01)

(52) U.S. Cl.
CPC ..... *B41J 11/0021* (2021.01)

(58) Field of Classification Search
CPC ..... B41J 11/0021; B41J 11/00218; B41J 13/0027; B41J 11/00212
See application file for complete search history.

(56) References Cited

U.S. PATENT DOCUMENTS 10,882,337 B1 * 1/2021 Condello ..... B41J 11/002

FOREIGN PATENT DOCUMENTS

| | | | |
|---|---|---|---|
| GB | 2471376 | A | 12/2010 |
| JP | 2005-313445 | A | 11/2005 |
| JP | 2010-94882 | A | 4/2010 |
| JP | 2011-5726 | A | 1/2011 |
| JP | 2017-144641 | A | 8/2017 |

* cited by examiner

*Primary Examiner* — Bradley W Thies
(74) *Attorney, Agent, or Firm* — Scully, Scott, Murphy & Presser, PC

(57) ABSTRACT

A liquid discharge apparatus includes: a head, a radiation unit, a movement mechanism, and a controller. The controller configured to: select a first recording mode or a second recording mode; control the head, the radiation unit, and the movement mechanism to execute a first image recording process when that the first recording mode is selected; and control the head, the radiation unit, and the movement mechanism to execute a second image recording process when the second recording mode is selected. The second image recording process includes radiating the light in a state in which a mutual positional relationship among the plurality of light sources or a mutual light emission intensity relationship among the plurality of light sources is different from that in the first image recording process, so that a difference between a first maximum radiation intensity and a second maximum radiation intensity is not more than a predetermined value.

19 Claims, 10 Drawing Sheets

LIQUID DISCHARGE APPARATUS

CROSS REFERENCE TO RELATED APPLICATION

The present application claims priority from Japanese Patent Application No. 2020-063240 filed on Mar. 31, 2020, the disclosure of which is incorporated herein by reference in its entirety.

BACKGROUND OF THE INVENTION

Field of the Invention

The present invention relates to a liquid discharge apparatus based on the use of a liquid which is curable by being irradiated with a ray of light.

Description of the Related Art

A liquid discharge apparatus is known, which records an image by using a photocurable ink which is curable by being irradiated with a ray of light. For example, Japanese Patent Application Laid-open No. 2005-313445 discloses an ink-jet recording apparatus (liquid discharge apparatus) comprising recording heads each of which is formed with nozzles for discharging an ultraviolet curable ink (hereinafter referred to as "UV ink") from the nozzles onto a recording medium, an ultraviolet radiation device which is provided with an ultraviolet light source for curing the ink by radiating an ultraviolet ray onto the recording medium on which the ink has been landed, and a carriage which is movable in the main scanning direction while carrying the plurality of recording heads and the ultraviolet radiation device. The UV ink can be cured by the ultraviolet radiation, and the ink can be fixed on the recording medium. Therefore, the image can be also recorded on a recording medium such as a resin or the like into which any water-based ink cannot permeate.

In the meantime, in recent years, there is such a need that it is demanded to perform the image recording by using a photocurable ink on a recording medium having a three-dimensional surface (having, for example, a cylindrical shape, a spherical shape, or a concave/convex shape). When the image recording is performed on the recording medium having the three-dimensional surface by using the apparatus of Japanese Patent Application Laid-open No. 2005-313445, as shown in FIG. 10, the distance between the light-outgoing surface 202 of the ultraviolet radiation device 201 and the surface of the recording medium 210 differs depending on the place or position of the recording medium.

On this account, if the ultraviolet ray is radiated from the ultraviolet radiation device 201 at an identical light emission intensity, the larger the distance between the light-outgoing surface 202 of the ultraviolet radiation device 201 and the surface of the recording medium 210 is, the smaller the radiation intensity (illuminance) is. For example, with reference to FIG. 10, if the ultraviolet ray is radiated from the ultraviolet radiation device 201, the radiation intensity obtained at a portion having a distance x is smaller than that of a portion of a distance y (x>y). In this case, in order to cure the UV ink, it is necessary to radiate the ultraviolet ray so that the totalized light amount radiated onto the UV ink (radiation intensity×radiation time, multiplying radiation intensity by radiation time) is not less than a certain value. Therefore, assuming that the radiation time is constant, in order to cure the UV ink at the portion having the large distance x, it is necessary to adjust the light emission intensity of the ultraviolet radiation device 201 so that the totalized light amount is not less than the certain value at the portion of the distance x. However, in this situation, an excessive amount of the ultraviolet ray is radiated onto the surface of the recording medium 210 at the portion of the distance y. Then, the surface temperature of the portion of the distance y of the recording medium 210 is raised by the thermal energy of the ultraviolet ray, and it is feared that the deformation of the recording medium 210 may be caused. On the other hand, if the light emission intensity of the ultraviolet radiation device 201 is adjusted so that the totalized light amount is not less than the certain value at the portion of the distance y, then the radiation intensity is insufficient at the portion of the distance x, and it is impossible to sufficiently cure the UV ink.

An object of the present disclosure is to provide a liquid discharge apparatus in which any insufficient curing of a photocurable ink is hardly caused while suppressing the damage on a recording medium when the image recording is performed by using the photocurable ink on the recording medium having a surface of a three-dimensional shape.

SUMMARY OF THE INVENTION

According to the present disclosure, there is provided a liquid discharge apparatus for recording an image on a surface of a recording medium, the liquid discharge apparatus including:

a head which has a nozzle surface having a plurality of nozzles and which is configured to discharge a photocurable liquid from the plurality of nozzles;

a radiation unit which has a plurality of light sources and which is configured to radiate light from the light sources to cure the liquid;

a movement mechanism which is configured to move the recording medium or both of the head and the radiation unit in a direction parallel to the nozzle surface; and a controller configured to:

select one of a first recording mode and a second recording mode, the first recording mode being selected under a condition that a difference between a maximum value and a minimum value of a radiation distance is less than a predetermined length, the second recording mode being selected under a condition that the difference is not less than the predetermined length, and the radiation distance being a distance in a first direction orthogonal to the nozzle surface from a predetermined range on a surface of the recording medium to the radiation unit;

control the head, the radiation unit, and the movement mechanism to execute a first image recording process under a condition that the first recording mode is selected; and control the head, the radiation unit, and the movement mechanism to execute a second image recording process under a condition that the second recording mode is selected, wherein the first image recording process includes:

discharging the liquid from at least one of the plurality of nozzles to the predetermined range while moving the recording medium or both of the head and the radiation unit; and radiating the light from the plurality of light sources onto the liquid landed onto the predetermined range, and the second image recording process includes:

discharging the liquid from at least one of the plurality of nozzles to the predetermined range while moving the recording medium or both of the head and the radiation unit; and radiating the light from the plurality of light sources onto the liquid landed onto the predetermined range in a state in which a mutual positional relationship among the plurality of light sources or a mutual light emission intensity relationship among the plurality of light sources is different from that in the first image recording process, so that a difference between a first maximum radiation intensity and a second maximum radiation intensity is not more than a predetermined value, the first maximum radiation intensity being a maximum radiation intensity of the light radiated onto a first area, in the predetermined range, at which the radiation distance has the maximum value, and the second maximum radiation intensity being a maximum radiation intensity of the light radiated onto a second area, in the predetermined range, at which the radiation distance has the minimum value.

BRIEF DESCRIPTION OF THE DRAWINGS

FIGS. 7A and 7B relate to a printer according to a second embodiment, wherein FIG. 7A shows a bottom view illustrating a radiation head in a first image recording process, and FIG. 7B shows a bottom view illustrating the radiation head in a second image recording process.

FIGS. 8A and 8B relate to a printer according to a third embodiment, wherein FIG. 8A shows a sectional view illustrating a radiation head in a first image recording process, and FIG. 8B shows a sectional view illustrating the radiation head in a second image recording process.

DESCRIPTION OF THE PREFERRED EMBODIMENTS

First Embodiment

Figure 1:
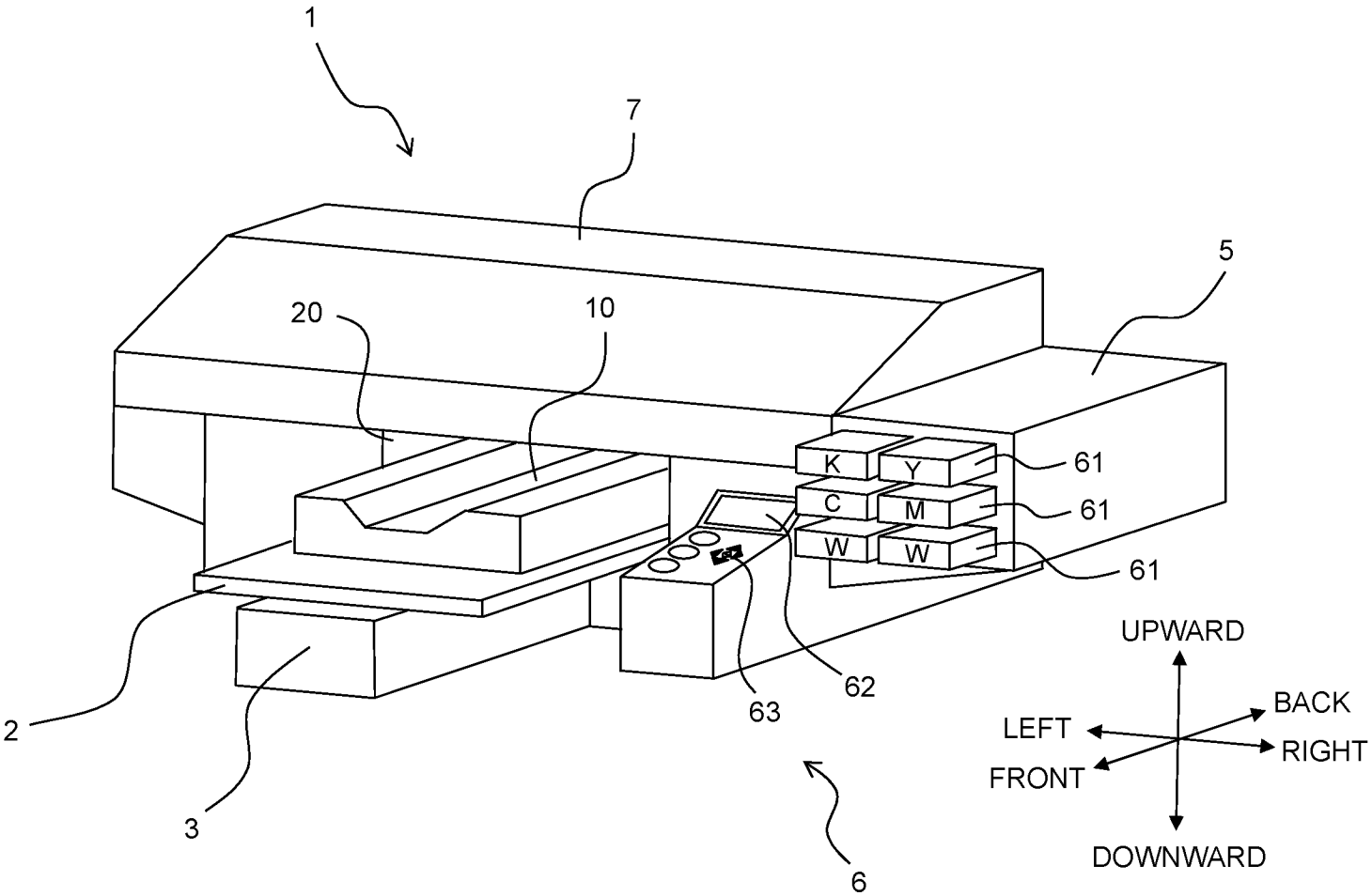
FIG. 1 shows a schematic perspective view illustrating an appearance of a printer according to a first embodiment of the present disclosure.

A printer 1 according to a first embodiment of the present disclosure will be explained below with reference to FIGS. 1 to 6. Note that the upward-downward direction, the front-back direction, and the left-right direction shown in FIG. 1 are defined as the upward-downward direction, the front-back direction, and the left-right direction of the printer 1. The upward-downward direction (orthogonal direction, first direction) is orthogonal to a nozzle surface 45 of an ink-jet head 42 described later on. The left-right direction (scanning direction, second direction) is orthogonal to the upward-downward direction and parallel to the nozzle surface 45. Further, the front-back direction (conveying direction, third direction) is orthogonal to the upward-downward direction and the left-right direction and parallel to the nozzle surface 45.

<Overall Configuration of Printer 1>

Figure 2:
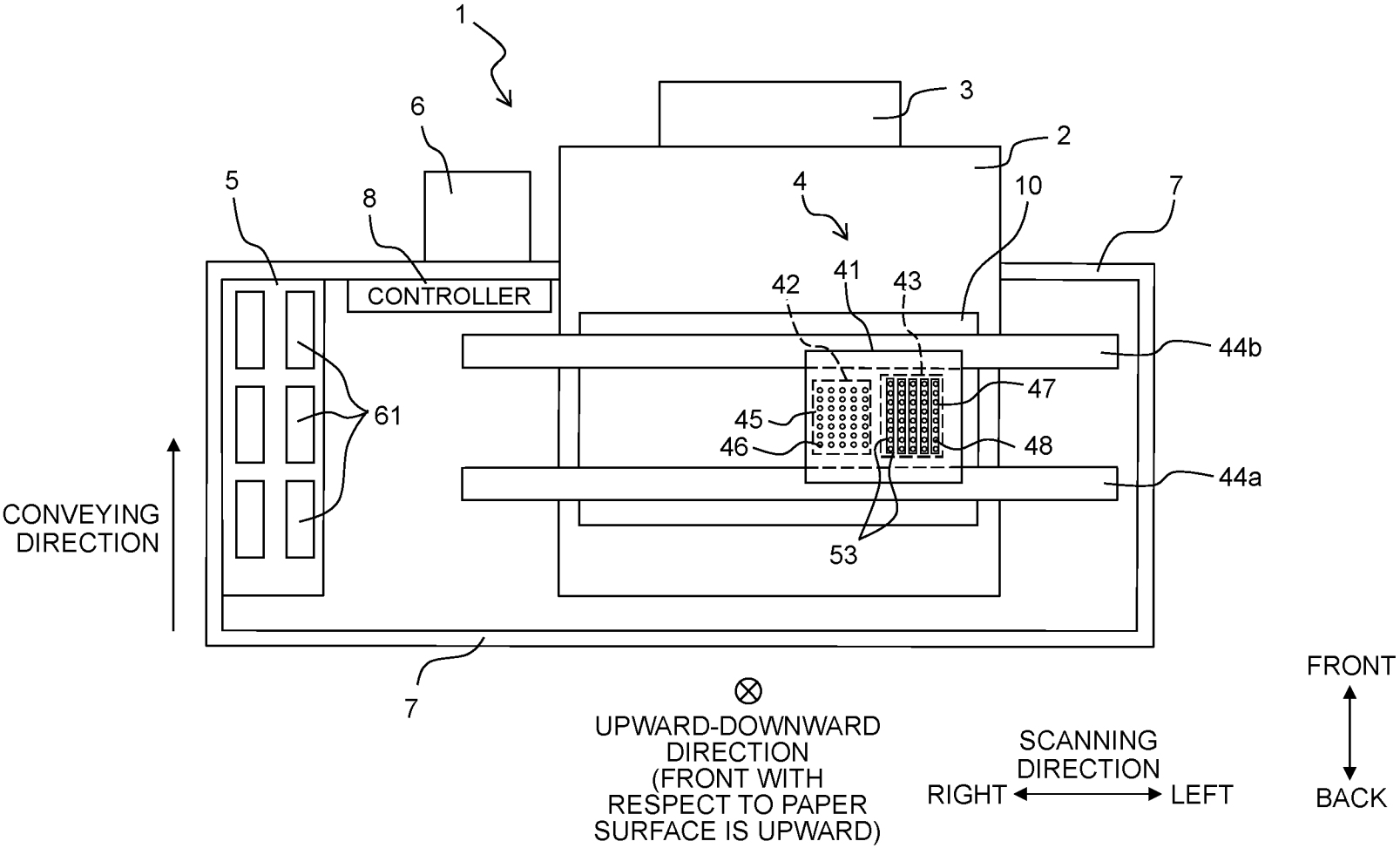
FIG. 2 shows a schematic top view illustrating an internal structure of the printer according to the first embodiment of the present disclosure.
Figure 3:
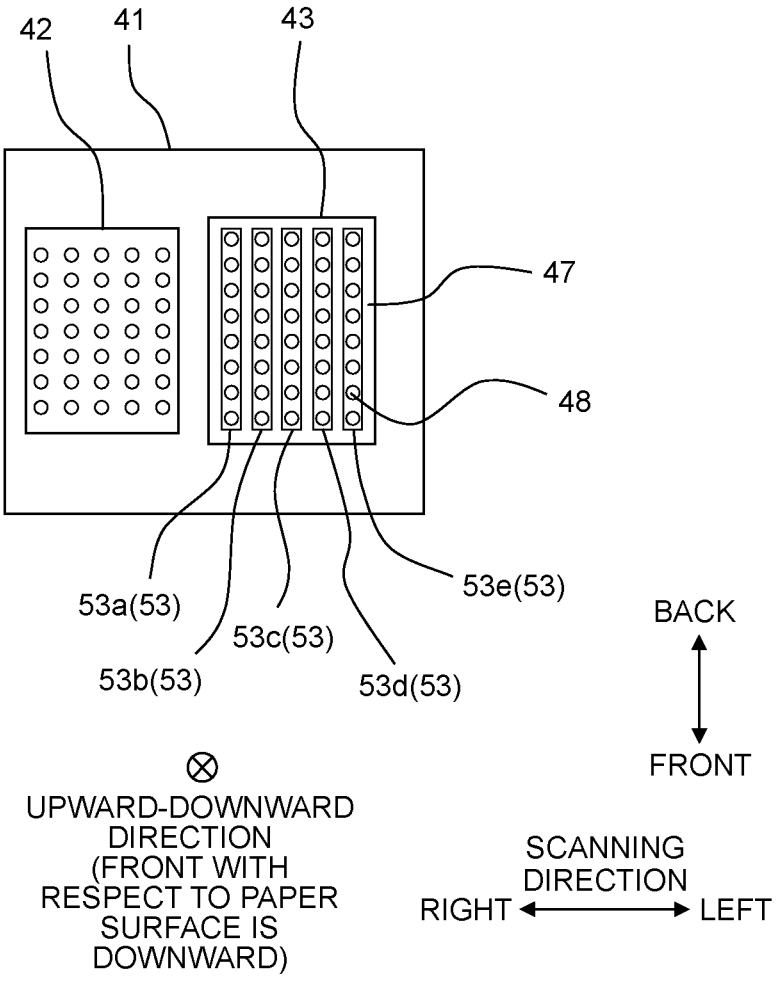
FIG. 3 shows a cross-sectional side view illustrating a radiation head.

As shown in FIGS. 1 and 2, the printer 1 (liquid discharge apparatus of the present disclosure) includes a platen 2, a conveying mechanism 3, a scanning mechanism 4 (movement mechanism of the present disclosure), an ink chamber 5, a control panel 6, a casing 7, and a control unit 8. An opening 20 is provided on a front surface of the casing 7.

The platen 2 is a flat plate-shaped member, and a recording medium 10 is placed on the upper surface. The platen 2 extends from the inside of the casing 7 through the opening 20 toward the front of the printer 1 in the vicinity of the center in the left-right direction of the printer 1. The conveying mechanism 3 is arranged under or below the platen 2. The driving force is applied from a conveying motor 31 (see FIG. 4). The platen 2 is allowed to slide in the conveying direction directed from the back to the front. Accordingly, the recording medium 10, which is placed on the upper surface of the platen 2, is conveyed in the conveying direction. Note that in the first embodiment, the recording medium 10 has a three-dimensional shape having a concave/convex surface.

As shown in FIG. 2, the scanning mechanism 4 has a carriage 41 and two guide rails 44*a*, 44*b*. An ink-jet head 42 (head of the present disclosure) and a radiation head 43 (radiation unit of the present disclosure) are carried on the carriage 41. The carriage 41 is arranged over or above the platen 2 at the inside of the casing 7. The carriage 41 is supported by the two guide rails 44*a*, 44*b*. The two guide rails 44*a*, 44*b* are arranged while being separated from each other in the front-back direction, and the two guide rails 44*a*, 44*b* extend in the left-right direction respectively. The carriage 41 is arranged to stride over the two guide rails 44*a*, 44*b*. Then, the carriage 41 is driven to make the reciprocative movement in the left-right direction as the scanning direction along the two guide rails 44*a*, 44*b* by means of a carriage motor 32 (see FIG. 4). That is, the printer 1 of this embodiment is a serial printer.

The ink-jet head 42 is carried on the carriage 41 so that a nozzle surface (discharge surface) 45, which is the lower surface of the ink-jet head 42, is opposed to the platen 2. The ink-jet head 42 is reciprocatively movable in the scanning direction together with the carriage 41. A plurality of nozzles 46 (discharge ports) are formed on the nozzle surface 45 in order to discharge inks. As shown in FIG. 2, the plurality of nozzles 46 are aligned at equal intervals in the conveying direction (front-back direction) orthogonal to the scanning direction to form nozzle arrays (nozzle rows). The nozzle arrays (nozzle rows) are arranged in five arrays in the scanning direction. Further, the inks, which are supplied from ink cartridges 61 for storing the inks of five colors (black, cyan, magenta, yellow, and white) as described later on, are discharged from the respective arrays of the nozzles 46 disposed on the nozzle surface 45 of the ink-jet head 42. Thus, an image is recorded on the recording medium 10. Note that the five color inks, which are discharged from the nozzles 46, are ultraviolet curable inks (photocurable liquids) which are cured by being irradiated with the ultraviolet ray.

The radiation head 43 is carried on the carriage 41 so that the radiation head 43 is positioned on the left side of the ink-jet head 42. The radiation head 43 is reciprocatively movable in the scanning direction together with the carriage 41 in the same manner as the ink-jet head 42. The radiation head 43 has a substrate 47 and lamp chips (light sources of the present disclosure) 48. As shown in FIG. 2, the lamp chips (light sources of the present disclosure) 48 are formed on the substrate 47.

The substrate 47 is a flat plate-shaped member arranged at a lower portion of the radiation head 43, on which a circuit (not shown) is formed to supply the current to the lamp chips 48. The magnitude of the current flowing through the circuit is adjusted by the control unit (controller) 8 as described later on. Further, the lower surface of the substrate 47 is parallel to the upper surface of the platen 2.

The lamp chips 48 are provided in order to radiate the ultraviolet ray onto the recording medium 10 placed on the upper surface of the platen. The plurality of lamp chips 48 are arranged on the lower surface of the substrate 47. The plurality of lamp chips 48 are connected to the circuit (not shown) arranged on the substrate 47. The light emission intensity L of the ultraviolet ray of the lamp chip 48 is determined by the magnitude of the current supplied from the circuit formed on the substrate 47. As shown in FIG. 2, the plurality of lamp chips 48 form lamp chip arrays (lamp chip rows, light source rows) 53, and in each of the lamp chip arrays (lamp chip rows, light source rows) 53, eight lamp chips 48 are aligned at equal intervals in the conveying direction. Five lamp chip arrays 53 are arranged in the scanning direction, and they are designated as "lamp chip arrays 53*a*, 53*b*, 53*c*, 53*c*, 53*e*" in this order as referred to from the right in the scanning direction (see FIG. 3). The respective lamp chip arrays 53 are arranged at equal intervals. Further, as shown in FIG. 2, the lamp chips 48, which are included in the plurality of lamp chips 48 and which are arranged at the both ends in the conveying direction, are disposed at outer positions in the conveying direction as compared with the nozzles 46 which are included in the plurality of nozzles 46 and which are arranged at the both ends in the conveying direction. In the first embodiment, the lamp chips 48 are LED lamps. However, the lamp chips 48 are not limited to the LED lamps, which may be, for example, mercury lamps, cold cathode tubes, or metal halide lamps.

The ink chamber 5 is the portion which is provided in order to accommodate six ink cartridges 61. As shown in FIGS. 1 and 2, the ink chamber 5 is provided on the right side in the left-right direction of the printer 1. Five color inks of black, cyan, magenta, yellow, and white are stored respectively in the six ink cartridges 61. Each of the black, cyan, magenta, and yellow inks is stored in one ink cartridge 61. The white ink is stored in two ink cartridges 61. Then, the six ink cartridges 61 are connected to the ink-jet head 42 to supply the inks to the nozzles 46 corresponding to the respective colors. Note that in FIG. 2, as for the six ink cartridges 61, the two arrays, which are arranged in the scanning direction, are aligned in three arrays in the conveying direction in order to view the drawing more comprehensively. However, actually, as shown in FIG. 1, as for the six ink cartridges 61, the two arrays, which are arranged in the scanning direction, are aligned in three arrays in the upward-downward direction. Then, the black cartridge is arranged on the left side, and the yellow cartridge is arranged on the right side in the upper array. The cyan cartridge is arranged on the left side, and the magenta cartridge is arranged on the right side in the middle array. The white cartridges are arranged on the both left and right sides in the lower array.

The control panel 6 is the portion which receives the printing setting and the shape data of the recording medium 10 inputted by a user. As shown in FIGS. 1 and 2, the control panel 6 is provided on the front surface of the printer 1 while being disposed on the right side. The control panel 6 has a monitor 62 which displays the printing setting and the operation situation of the printer 1 and buttons 63 which are provided for the user to input the predetermined printing setting and the shape data of the recording medium 10. Note that the control panel 6 may have a touch panel which makes it possible to input the printing setting and the shape data of the recording medium 10 by directly touching the display on the monitor.

Figure 4:
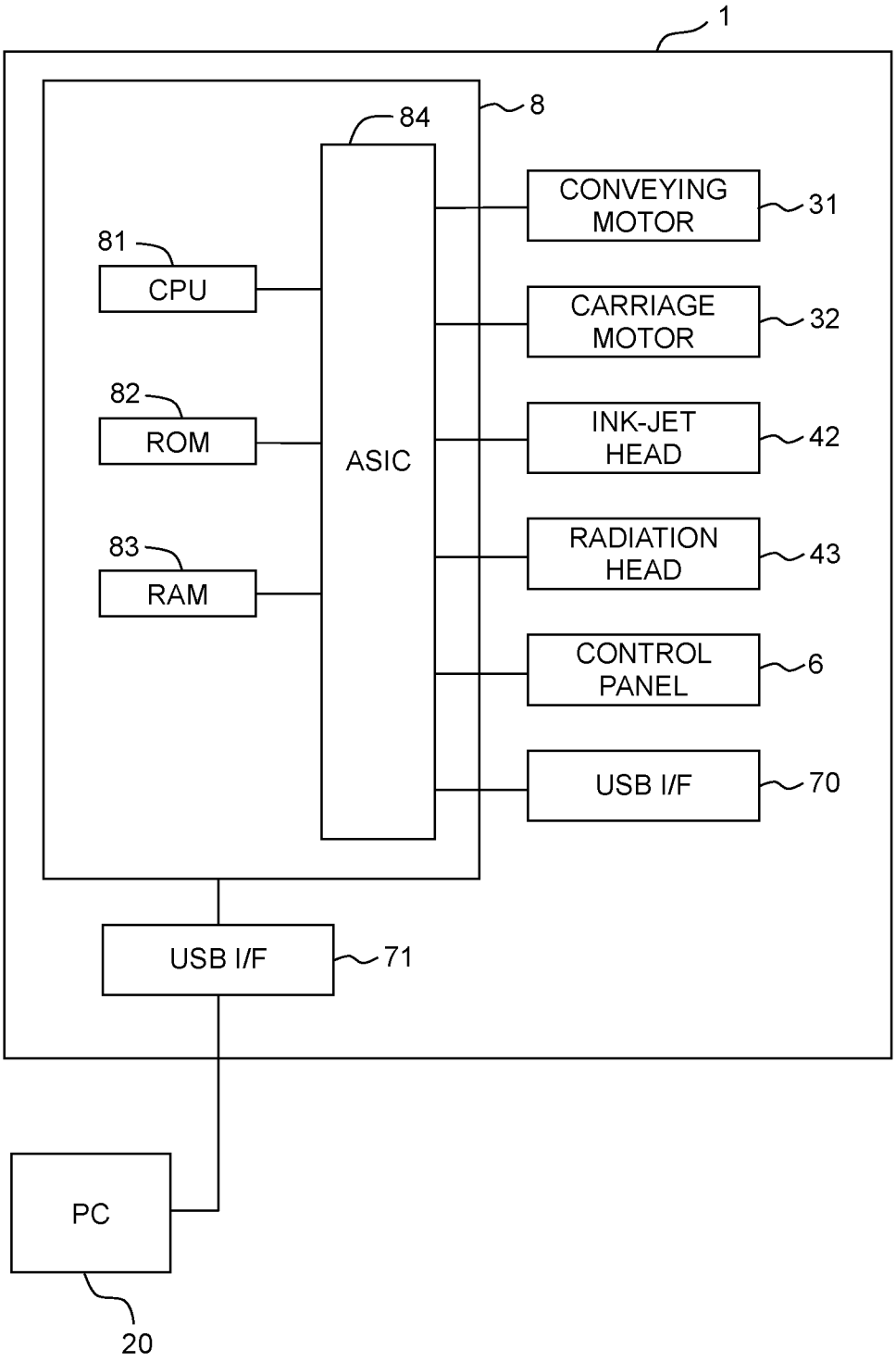
FIG. 4 shows a block diagram schematically illustrating electric configuration of the printer shown in FIG. 1 and PC connected thereto.
Figure 5A:
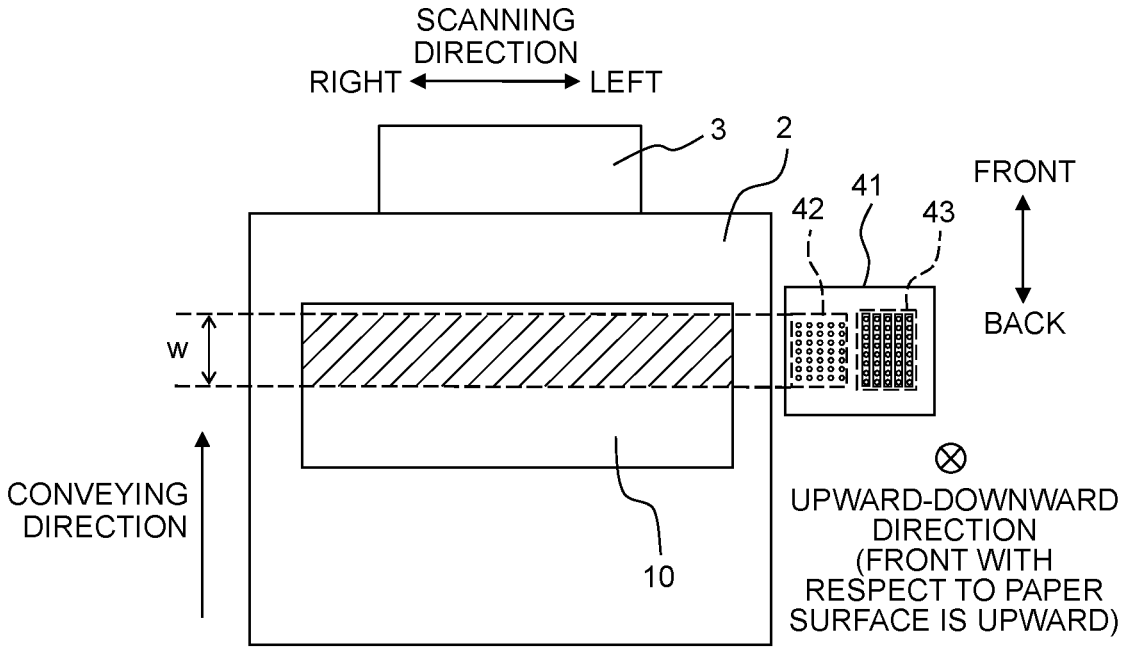
FIG. 5A shows a top view illustrating a carriage passing area on a surface of a recording medium.
Figure 5B:
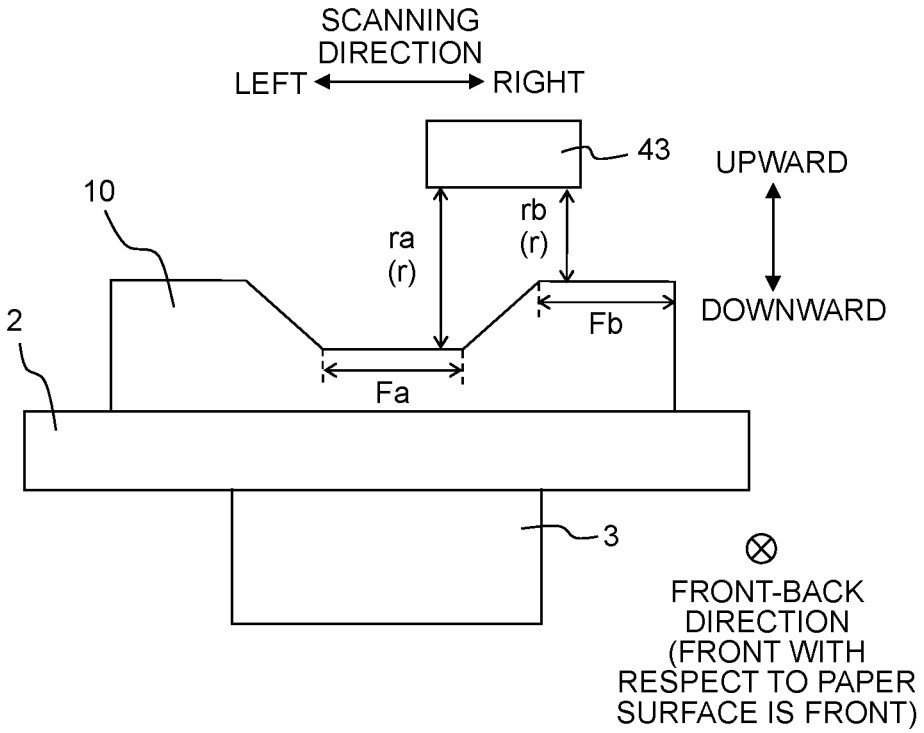
FIG. 5B shows a front view illustrating distances (radiation distances) from the surface of the recording medium to the radiation head.

The control unit 8 (controller) controls the entire printer 1. As shown in FIG. 4, those electrically connected to the control unit 8 include, for example, the conveying motor 31, the carriage motor 32, the ink-jet head 42, the radiation head 43, and the control panel 6. Further, a USB interface 70 is electrically connected to the control unit 8. The USB interface 70 is the interface based on the USB standard, to which a USB memory can be connected as a removable memory. Additionally, PC (Personal Computer) 20 as an external apparatus is connected to the control unit 8 via the USB interface 71. Note that the printer 1 and PC 20 may be connected via LAN (Local Area Network). Alternatively, the printer 1 and PC 20 may be connected, for example, by means of USB without using LAN intervening therebetween. Further, the data sending/receiving between the printer 1 and PC 20 may be performed by the communication based on a wireless system, or performed by the communication based on a wired system. Further, a portable terminal such as a smartphone or the like can be connected in a wireless manner to the printer 1 directly or by the aid of LAN.

The control unit 8 includes, for example, CPU (Central Processing Unit) 81, ROM (Read Only Memory) 82, RAM (Random Access Memory) 83, and ASIC (Application Specific Integrated Circuit) 84. ROM 82 stores, for example, various fixed data and programs to be executed by CPU 81 and ASIC 84. RAM 83 temporarily stores data (for example, image data) required when the program is executed.

Note that in the first embodiment, the control panel 6 and the USB interface 70 correspond to the data receiving unit of the present disclosure.

<Operation of Printer 1>

Figure 6:
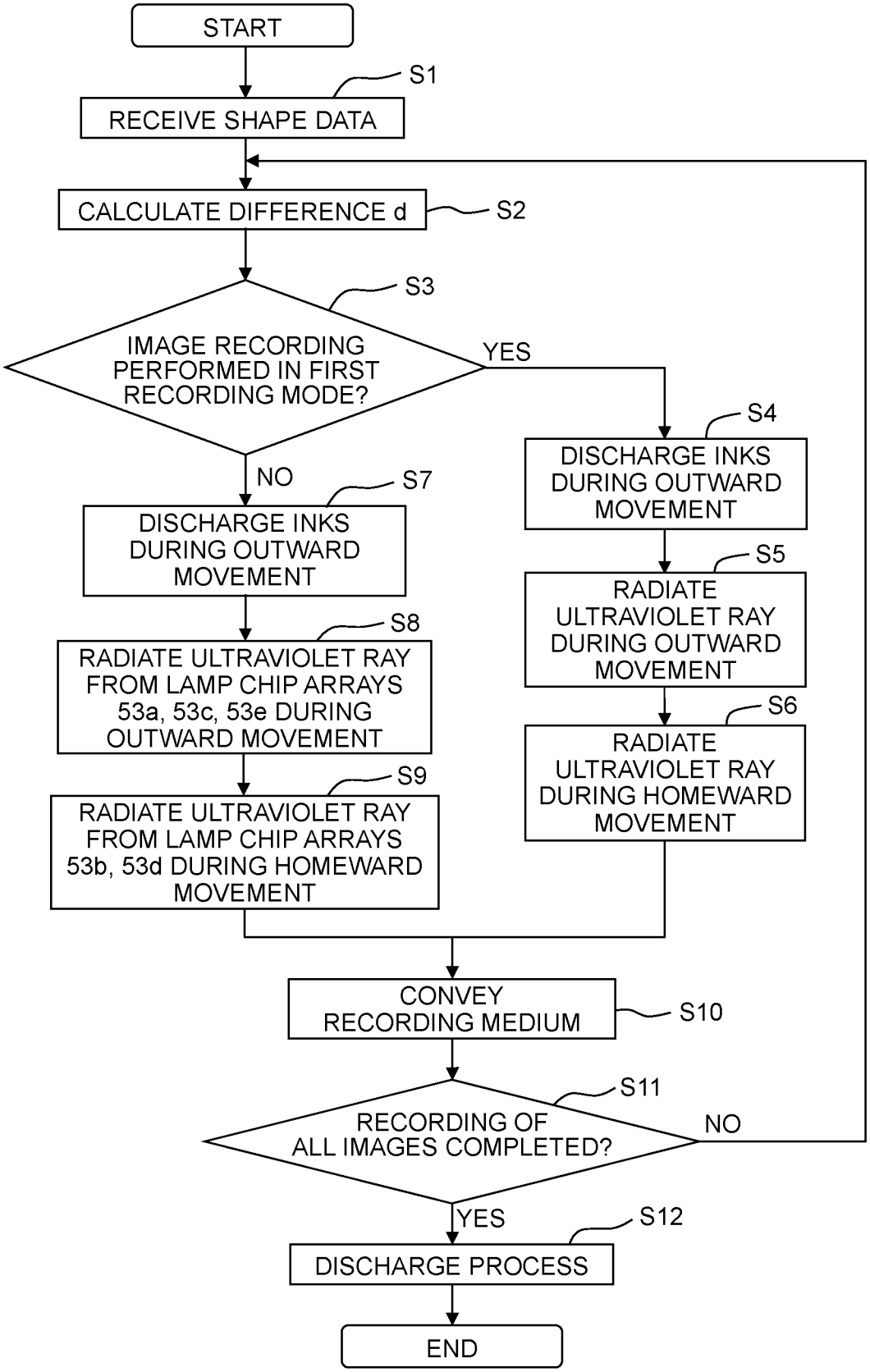
FIG. 6 shows a flow chart illustrating a recording operation of the printer according to the first embodiment.

Next, an explanation will be made with reference to a flow chart shown in FIG. 6 about the operation to be performed when the printer 1 of the first embodiment records an image on the recording medium 10. At first, the image data of the image to be recorded on the recording medium 10 is supplied to the printer 1 on the basis of the operation performed by the user for PC 20. The image data is temporarily stored in RAM 83.

Subsequently, the shape data of the recording medium 10 is inputted into the control panel 6 by the user. In another situation, the USB memory which stores the shape data of the recording medium 10 or the communication cable connected to an external device in which the shape data of the recording medium 10 is stored is connected to the USB interface 70. Accordingly, the control panel 6 or the USB interface 70 receives the shape data of the recording medium 10 (Step S1).

Subsequently, the control unit 8 calculates the difference d (Step S2) between the maximum value ra and the minimum value rb of a distance (radiation distance) r on the basis of the shape data of the recording medium 10 and the image data stored in RAM 83. The distance r is the distance in the upward-downward direction from a predetermined range on the surface of the recording medium 10 to the lower surface of the radiation head 43. Note that the predetermined range in this embodiment is a range (recording range) in which the image is recorded on the surface of the recording medium 10. Further, a passing area W (see FIG. 5A) in which the image can be recorded when the carriage 41 passes in the scanning direction is overlaps the predetermined range. Further, with reference to FIG. 5B, the carriage 41 and the ink-jet head 42 are omitted from the illustration. Then, the control unit 8 executes the mode judging process (Step S3) for judging in which mode the image recording is performed with respect to the predetermined range in the passing area W, the mode including the first recording mode and the second recording mode. The first recording mode corresponds to the condition that the difference d is less than the predetermined length L and the second recording mode corresponds to the condition that the difference d is not less than the predetermined length L. Note that the predetermined length L is, for example, previously set by a user. For example, the predetermined length L may be 0.1 mm to 2.0 mm or 1.0 mm to 20.0 mm.

If it is judged by the mode judging process that the image recording is performed in the first recording mode (S3: YES), the control unit 8 discharges the inks from the nozzles 46 of the ink-jet head 42 (Step S4) toward the inside of the predetermined range in the passing area W on the surface of the recording medium 10 to during the outward movement in which the carriage 41 is moved from the left side toward the right side in the scanning direction by the scanning mechanism 4.

Subsequently, the control unit 8 radiates the ultraviolet rays at the same light emission intensity (Step S5) from all of the lamp chip arrays 53 of the radiation head 43 toward the landing area of the inks landed within the predetermined range in the passing area W on the surface of the recording medium 10 immediately after the inks are discharged from the nozzles 46 of the ink-jet head 42, during the outward movement directed from the left side to the right side in the scanning direction of the carriage 41 as effected by the scanning mechanism 4. That is, the control unit 8 continuously executes Step S4 and Step S5 during one time of the outward movement in the scanning direction of the carriage 41.

After that, the control unit 8 radiates the ultraviolet rays at the same light emission intensity (Step S6) from all of the lamp chip arrays 53 of the radiation head 43 again toward the landing area of the inks landed within the predetermined range in the passing area W during the homeward movement directed from the right side to the left side in the scanning direction of the carriage 41 as effected by the scanning mechanism 4. Steps S4 to S6 of this embodiment correspond to the first image recording process of the present disclosure.

If it is judged by the mode judging process that the image recording is performed in the second recording mode (S3: NO), the control unit 8 discharges the inks from the nozzles 46 of the ink-jet head 42 (Step S7) toward the inside of the predetermined range in the passing area W during the outward movement in which the carriage 41 is moved from the left side toward the right side in the scanning direction by the scanning mechanism 4, in the same manner as in Step S4.

Subsequently, the control unit 8 radiates the ultraviolet rays at the first light emission intensity (Step S8) from the lamp chip arrays 53*a*, 53*c*, 53*e* of the radiation head 43 toward the landing area of the inks landed within the predetermined range in the passing area W immediately after the inks are discharged from the nozzles 46 of the ink-jet head 42, during the outward movement directed from the left side to the right side in the scanning direction of the carriage 41 as effected by the scanning mechanism 4. In this situation, the ultraviolet rays are not radiated from the lamp chip arrays 53*b*, 53*d*. That is, as for the outward movement of the carriage 41, the lamp chip arrays 53*a*, 53*c*, 53*e* correspond to the first light source arrays of the present disclosure, and the lamp chip arrays 53*b*, 53*d* correspond to the second light source arrays of the present disclosure. In other words, the control unit 8 controls the radiation head 43 so that the lamp chip arrays 53*a*, 53*c*, 53*e* (first light source arrays) are selected from the plurality of lamp chip arrays 53, and the ultraviolet rays are radiated at the first light emission intensity from the selected lamp chip arrays 53*a*, 53*c*, 53*e*. Further, the control unit 8 controls the radiation head 43 so that the lamp chip arrays 53*b*, 53*d* (second light source arrays) are selected from the plurality of lamp chip arrays 53, and the ultraviolet rays are not radiated from the selected lamp chip arrays 53*b*, 53*d*. In the same manner as described above, the control unit 8 continuously executes Step S7 and Step S8 during one time of the outward movement in the scanning direction of the carriage 41.

After that, the control unit 8 radiates the ultraviolet rays at the first light emission intensity (Step S9) from the lamp chip arrays 53*b*, 53*d* of the radiation head 43 toward the landing area of the inks landed within the predetermined range in the passing area W, during the homeward movement directed from the right side to the left side in the scanning direction of the carriage 41 as effected by the scanning mechanism 4. In this situation, the ultraviolet rays are not radiated from the lamp chip arrays 53*a*, 53*c*, 53*e*. That is, as for the homeward movement of the carriage 41, the lamp chip arrays 53*b*, 53*d* correspond to the first light source arrays of the present disclosure, and the lamp chip arrays 53*a*, 53*c*, 53*e* correspond to the second light source arrays of the present disclosure. In other words, the control unit 8 controls the radiation head 43 so that the lamp chip arrays 53*b*, 53*d* (first light source arrays) are selected from the plurality of lamp chip arrays 53, and the ultraviolet rays are radiated at the first light emission intensity from the selected lamp chip arrays 53*b*, 53*d*. Further, the control unit 8 controls the radiation head 43 so that the lamp chip arrays 53*a*, 53*c*, 53*e* (second light source arrays) are selected from the plurality of lamp chip arrays 53, and the ultraviolet rays are not radiated from the selected lamp chip arrays 53*a*, 53*c*, 53*e*.

In Step S8 and Step S9, the first light emission intensity is set so that the difference between the first maximum radiation intensity and the second maximum radiation intensity is not more than the predetermined value P. The first maximum radiation intensity is a maximum radiation intensity of the ultraviolet ray radiated onto the first area Fa (see FIG. 5B) in the passing area W on the surface of the recording medium, at which the distance r has the maximum value ra; and the second maximum radiation intensity is a maximum radiation intensity of the ultraviolet ray radiated onto the second area Fb (see FIG. 5B) in the passing area W on the surface of the recording medium 10, at which the distance r has the minimum value rb. Further, the predetermined value P is the difference in the radiation intensity between the maximum value and the minimum value at which it is possible to cure the inks landed on the first area Fa in the passing area W on the surface of the recording medium 10 and it is possible to avoid the deformation of the recording medium 10 in the second area Fb caused by the ultraviolet ray radiation. For example, the predetermined value P may be 0 W/cm$^2$ to 3.0 W/cm$^2$, or 0 W/cm$^2$ to 1.0 W/cm$^2$. The first light emission intensity in Step S8 may be either identical with or different from the first light emission intensity in Step S9. Steps S7 to S9 of this embodiment correspond to the second image recording process of the present disclosure.

After the execution of Step S6 or Step S9, the control unit 8 executes the conveyance process for conveying the recording medium 10 in the conveying direction by means of the conveying mechanism 3 (Step S10) so that at least the end portion on the downstream side in the conveying direction of the portion of the predetermined range on the surface of the recording medium 10 on which the image is not recorded is included in the passing area W.

After that, the control unit 8 judges whether or not all of the images concerning the image data stored in RAM 83 are recorded in the predetermined range on the surface of the recording medium 10 (Step S11). If it is judged that all of the images are not recorded in the predetermined range on the surface of the recording medium 10 (S11: NO), then the control unit 8 returns to Step S2 to calculate the difference d between the maximum value ra and the minimum value rb of the distance r in relation to a new passing area W after the conveyance of the recording medium 10 in the conveying direction. If it is judged that all of the images are recorded in the predetermined range on the surface of the recording medium 10 (S11: YES), then the control unit 8 executes the conveyance process by the conveying mechanism 3 for conveying the recording medium 10 to the position at which the recording medium 10 can be taken out from the opening 20 (Step S12). According to the above, the operation, in which the printer 1 according to the first embodiment records the image on the recording medium 10, is terminated.

In the first embodiment, the control unit 8 executes the mode judging process for judging in which mode of the first recording mode and the second recording mode the image recording is performed. That is, the control unit 8 selects any one of the first recording mode and the second recording mode on the basis of the difference d between the maximum value ra and the minimum value rb of the distance r and the predetermined length L. If the difference d is less than the predetermined length L, the first recording mode is selected. If the difference d is not less than the predetermined length L, the second recording mode is selected. The distance r is the distance in the upward-downward direction from the predetermined range on the surface of the recording medium 10 to the radiation head 43. Then, if it is judged that the image recording is performed in the second recording mode, the control unit 8 executes the second image recording process. In the second image recording process, the ultraviolet rays are radiated from the plurality of lamp chips 48 in the state in which the mutual light emission intensity relationship among the plurality of lamp chips 48 is different from that provided in the first image recording process. In the second image recording process, the inks are discharged from the nozzles 46 of the ink-jet head 42, the ultraviolet rays are radiated immediately thereafter at the first light emission intensity from the lamp chip arrays 53*a*, 53*c*, 53*e* of the radiation head 43 so that the difference between the maximum radiation intensity of the ultraviolet ray radiated onto the first area Fa of the recording medium 10 and the maximum radiation intensity of the ultraviolet ray radiated onto the second area Fb is not more than the predetermined value P, and the ultraviolet rays are not radiated from the lamp chip arrays 53*b*, 53*d*, during the outward movement in the scanning direction of the carriage 41. According to this embodiment, if the difference d between the maximum value ra and the minimum value rb of the distance r is not less than the predetermined length L (i.e., the recording medium has the three-dimensional surface), then the second image recording process is performed, and thus it is possible to suppress the scattering or dispersion of the maximum radiation intensity of the ultraviolet ray on the surface of the recording medium 10. Accordingly, even when the image recording is performed by using the ultraviolet-curable inks on the recording medium 10 having the three-dimensional surface, any insufficient curing of the ultraviolet-curable inks can be hardly caused, while suppressing the damage exerted on the surface of the recording medium 10 by the ultraviolet radiation.

Further, the radiation intensity of the ultraviolet ray radiated onto the surface of the recording medium is increased by the superimposition of the ultraviolet rays radiated from the plurality of lamp chip arrays 53. In particular, the radiation intensity is more greatly increased by the superimposition of the ultraviolet rays in the second area Fb at which the distance has the minimum value rb, as compared with the first area Fa at which the distance r has the maximum value ra. According to the configuration of this embodiment, it is possible to avoid the superimposition of the ultraviolet ray radiated from the first light source array and the ultraviolet ray radiated from the second light source array, owing to the inexecution of the ultraviolet ray radiation from a part of the lamp chip arrays. Therefore, it is possible to avoid the increase in the radiation intensity which would be otherwise caused by the superimposition of the ultraviolet rays. Accordingly, it is possible to further decrease the difference in the maximum radiation intensity of the ultraviolet ray between the first area Fa and the second area Fb. It is possible to further suppress the damage on the surface of the recording medium 10.

Further, in the first embodiment, the control unit 8 uses at least two first light source arrays in the second image recording process, and one second light source array is allowed to exist between the two adjoining first light source arrays. According to this embodiment, it is possible to further decrease the range in which the ultraviolet rays radiated from the first light source arrays are superimposed with each other. It is possible to further suppress the damage on the surface of the recording medium 10.

Further, in the first embodiment, the apparatus further comprises the conveying mechanism 3 which conveys the recording medium 10 in the conveying direction. The control unit 8 repeatedly executes the first image recording process and/or the second image recording process, and the conveyance process for conveying the recording mechanism 10 in the conveying direction, until the recording of the image on the recording medium 10 is terminated. According to this embodiment, it is possible to perform the image recording by using the ultraviolet-curable inks in the serial printer in which the reciprocative movement of the carriage 41 in the scanning direction and the conveyance of the recording medium 10 in the conveying direction are performed.

Further, in the first embodiment, the control unit 8 uses, in the second image recording process, the lamp chip arrays 53*a*, 53*c*, 53*e* having been used as the first light source arrays during the outward movement of the carriage 41, as the second light source arrays during the homeward movement of the carriage 41, and the control unit 8 uses the lamp chip arrays 53*b*, 53*d* having been used as the second light source arrays during the outward movement of the carriage 41, as the first light source arrays during the homeward movement of the carriage 41. The first light source array (the lamp chip arrays 53*a*, 53*c*, 53*e*) of the outward movement is identical to the second light source array of the homeward movement, and the second light source array (the lamp chip arrays 53*b*, 53*d*) of the outward movement is identical to the first light source array of the homeward movement. The degree of deterioration is large in the lamp chip 48 in which the light emission intensity is increased, as compared with the lamp chip 48 in which the light emission intensity is decreased. If there is any scattering or dispersion in the degree of deterioration of the lamp chip 48, it is difficult to perform the adjustment for obtaining the light emission intensity required to cure the inks. In such a situation, it is impossible to sufficiently secure the quality of the recorded image. The configuration of the first embodiment makes it possible to uniformize the degrees of deterioration of the lamp chips 48. Therefore, it is easy to adjust the light emission intensity, and it is consequently possible to provide a long service life of the radiation head 43.

Further, in the first embodiment, the control panel 6 and the USB interface 70 are provided as the data receiving unit. Then, the control unit 8 acquires (calculates) the difference d between the maximum value ra and the minimum value rb of the distance r in relation to the passing area W on the basis of the shape data of the recording medium 10 received by the data receiving unit. In the mode judging process, the control unit 8 judges in which mode of the first recording mode and the second recording mode the image recording is performed, according to the difference d. According to this embodiment, it is possible to judge which mode of the first recording mode and the second recording mode is adequate, even when no instruction is made by the user. Therefore, it is possible to mitigate the operation load exerted on the user.

Second Embodiment

Next, a printer 1 according to a second embodiment will be explained with reference to FIG. 7. In the following description, those configured in the same manner as in the first embodiment are designated by the same reference numerals, any explanation of which will be appropriately omitted.

In the printer 1 according to the second embodiment, lamp chip arrays 153 (153*a* to 153*e*), which are arranged in five arrays in the scanning direction, are configured to be movable in the left-right direction. Then, the printer 1 according to the second embodiment is provided with an interval changing mechanism 90 which changes the intervals in the left-right direction (scanning direction) between the adjoining lamp chip arrays 153. As shown in FIG. 7, the interval changing mechanism 90 has six spring portions 91, two spring fixing portions 92, eight wedge portions 93, and two wedge portion movement mechanisms 94. The two spring fixing portions 92 are arranged respectively on the both sides in the left-right direction of the radiation head 143. The six spring portions 91 respectively connect the spring fixing portion 92 disposed on the left side and the lamp chip array 153*a* disposed on the left end, the spring fixing portion 92 disposed on the right side and the lamp chip array 153*e* disposed on the right end, and the mutually adjoining lamp chip arrays 153. The two wedge movement mechanisms 94 are arranged respectively on the both sides in the front-back direction of the radiation head 143. Four wedge portions 93 are attached to each of the wedge portion movement mechanism 94 disposed on the front side and the wedge portion movement mechanism 94 disposed on the back side. The wedge portion 93 has a shape of isosceles triangle as viewed in a top view. The wedge portion 93 is arranged so that the base is disposed on the side of the wedge portion movement mechanism 94, and the apex is positioned on the side of the radiation head 143. Each of the two wedge portion movement mechanism 94 is composed of, for example, a linear guide and a ball screw, which is driven to move in the front-back direction by means of an unillustrated wedge portion moving motor. The wedge portion moving motor is electrically connected to the control unit 8.

Figure 7A:
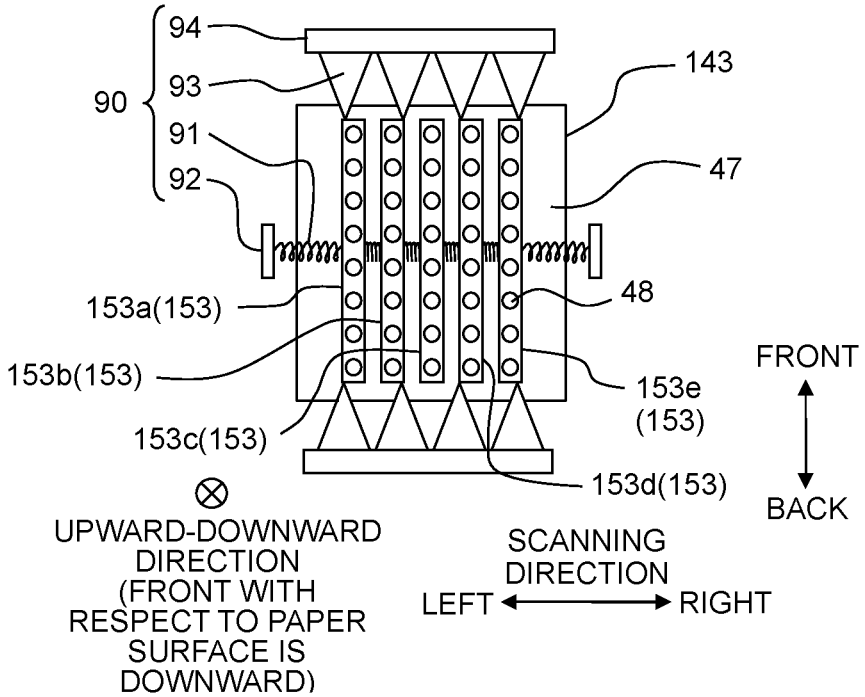
Figure 7B:
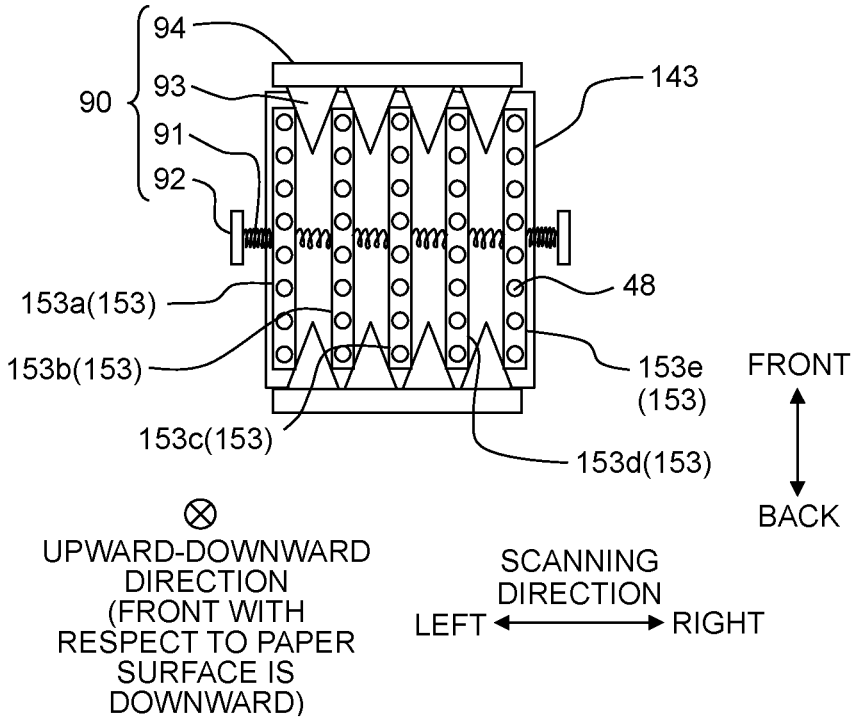

If the image recording is performed in the first recording mode in the second embodiment, the control unit 8 positions the tips (apexes) of the eight wedge portions 93 on the both outer sides in the front-back direction with respect to the respective lamp chip arrays 153 by means of the wedge portion movement mechanisms 94 (see FIG. 7A). In this situation, the respective spring portions 91 have natural lengths. The control unit 8 executes the first image recording process such that the inks are discharged toward the inside of the predetermined range in the passing area W during the outward movement in the scanning direction of the carriage 41 in the state in which the wedge portions 93 are disposed at the foregoing positions, and the ultraviolet rays are radiated at the same light emission intensity from all of the lamp chip arrays 153 of the radiation head 143 immediately thereafter toward the landing area of the inks.

On the other hand, if the image recording is performed in the second recording mode in the second embodiment, the control unit 8 operates the wedge portion movement mechanisms 94 so that the wedge portions 93, which are arranged in front of the radiation head 143, are moved backwardly thereby, and the wedge portions 93, which are arranged at the back of the radiation head 143, are moved frontwardly thereby. Accordingly, the respective wedge portions 93 are inserted between the adjoining lamp chip arrays 153 (see FIG. 7B). In accordance therewith, the four spring portions 91, which mutually connect the adjoining lamp chip arrays 153, are elongated in the left-right direction. The two spring portions 91, which include the spring portion 91 for connecting the spring fixing portion 92 disposed on the left side and the lamp chip array 153*a* disposed at the left end and the spring portion 91 for connecting the spring fixing portion 92 disposed on the right side and the lamp chip array 153*e* disposed at the right end, are pushed and shrunk in the left-right direction. Accordingly, the intervals in the left-right direction between the adjoining lamp chip arrays 153 are increased as compared with when the first image recording process is performed. In the situation in which the wedge portions 93 are in the states as described above, the control unit 8 executes the second image recording process such that the inks are discharged toward the inside of the predetermined range in the passing area W during the outward movement in the scanning direction of the carriage 41, and the ultraviolet rays are radiated immediately thereafter at the same light emission intensity from all of the lamp chip arrays 153 of the radiation head 143 toward the ink landing areas.

Note that the interval in the left-right direction between the adjoining lamp chip arrays 153 is set during the second image recording process so that the difference between the maximum radiation intensity of the ultraviolet ray radiated onto the first area Fa (see FIG. 5B) on the surface of the recording medium 10 at which the distance r has the maximum value ra in relation to the passing area W and the maximum radiation intensity of the ultraviolet ray radiated onto the second area Fb (see FIG. 5B) on the surface of the recording medium 10 at which the distance r has the minimum value rb is not more than the predetermined value P. Then, the movement distance in the front-back direction of the wedge portion 93 for defining the interval is set on the basis of the shape of the wedge portion 93.

In the second image recording process of the second embodiment, the ultraviolet rays are radiated from the plurality of lamp chips 48 in the state in which the mutual positional relationship among the plurality of lamp chips 48 is different from that provided in the first image recording process. According to the second embodiment, it is possible to further decrease the range in which the ultraviolet rays radiated from the adjoining lamp chips 153 are superimposed with each other. Accordingly, it is possible to decrease the difference in the maximum radiation intensity of the ultraviolet ray between the first area Fa at which the distance r has the maximum value ra and the second area Fb at which the distance r has the minimum value rb. It is possible to suppress the damage on the surface of the recording medium 10.

Third Embodiment

Next, a printer 1 according to a third embodiment will be explained with reference to FIG. 8. In the following description, those configured in the same manner as in the first embodiment are designated by the same reference numerals, any explanation of which will be appropriately omitted.

Figure 8A:
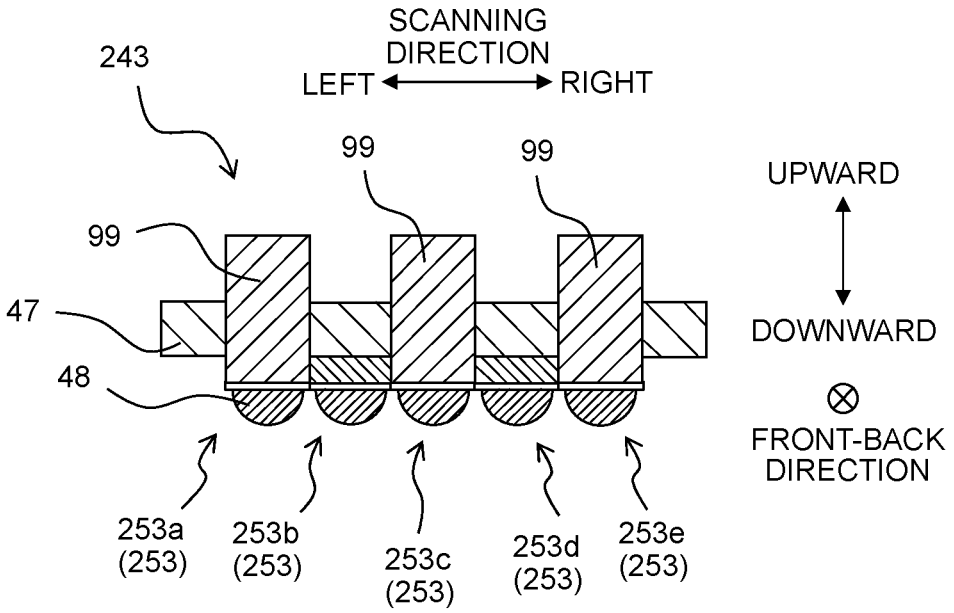
Figure 8B:
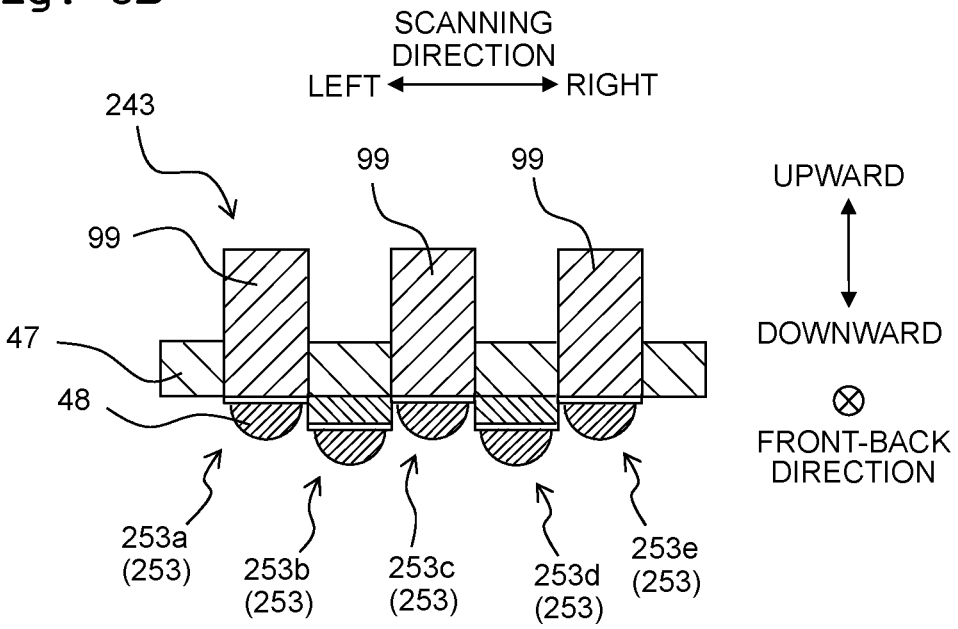

As shown in FIG. 8, the printer 1 according to the third embodiment is provided with position changing mechanisms 99 which change positions in the upward-downward direction of lamp chip arrays 253*a*, 253*c*, 253*e* of lamp chips 253 (253*a* to 253*e*) arranged in five arrays in the scanning direction. That is, in this embodiment, the lamp chip arrays 253*a*, 253*c*, 253*e* correspond to the third lamp chip arrays of the present disclosure, and the lamp chip arrays 253*b*, 253*d* correspond to the fourth light source arrays of the present disclosure. The lamp chip arrays 253*a*, 253*c*, 253*e* are attached respectively to the lower ends of the three position changing mechanisms 99. The position changing mechanism 99 is composed of, for example, a linear guide and a ball screw. The position changing mechanism 99 is driven by an unillustrated position changing motor so that the position changing mechanism 99 is moved in the upward-downward direction. The position changing motor is electrically connected to the control unit 8.

If the image recording is performed in the first recording mode in the third embodiment, the control unit 8 moves the lamp chip arrays 253*a*, 253*c*, 253*e* by means of the position changing mechanisms 99 so that the positions of all of the five lamp chip arrays 253 in the upward-downward direction are identical with each other (see FIG. 8A). The control unit 8 executes the first image recording process in the state in which the positions in the upward-downward direction of all of the lamp chip arrays 253 are identical with each other such that the inks are discharged toward the inside of the predetermined range in the passing area W during the outward movement in the scanning direction of the carriage 41, and the ultraviolet rays are radiated at the same light emission intensity toward the ink landing area from all of the lamp chip arrays 253 of the radiation head 243.

On the other hand, if the image recording is performed in the second recording mode in the third embodiment, the control unit 8 moves the lamp chip arrays 253*a*, 253*c*, 253*e* upwardly in the upward-downward direction by the position changing mechanisms 99. That is, the control unit 8 distances the lamp chip arrays 253*a*, 253*c*, 253*e* from the recording medium 10 as compared with when the first image recording process is performed. The control unit 8 executes the second image recording process in the state in which the lamp chip arrays 253*a*, 253*c*, 253*e* are moved upwardly in the upward-downward direction such that the inks are discharged toward the inside of the predetermined range in the passing area W during the outward movement in the scanning direction of the carriage 41, and the ultraviolet rays are radiated at the same light emission intensity toward the ink landing area from all of the lamp chip arrays 253 of the radiation head 243.

In the second image recording process of the third embodiment, the ultraviolet rays are radiated from the plurality of lamp chips 48 in the state in which the mutual positional relationship among the plurality of lamp chips 48 is different from that provided in the first image recording process. In the third embodiment, the radiation intensities of the ultraviolet rays radiated from the third light source arrays (lamp chip arrays 253*a*, 253*c*, 253*e*) onto the recording medium 10 are decreased. Further, it is possible to suppress the increase in the radiation intensity caused by the superimposition of the ultraviolet rays. Accordingly, it is possible to decrease the difference in the maximum radiation intensity of the ultraviolet ray between the first area Fa at which the distance r has the maximum value ra and the second area Fb at which the distance r has the minimum value rb. It is possible to suppress the damage on the surface of the recording medium 10.

Further, in the third embodiment, one third light source array (lamp chip array 253*c*) is allowed to exist between the two fourth light source arrays (lamp chip arrays 253*b*, 253*d*). Therefore, it is possible to further decrease the range of mutual superimposition of the ultraviolet rays radiated from the fourth light source arrays (lamp chip arrays 253*b*, 253*d*) positioned near to the recording medium 10 as compared with the third light source arrays (lamp chip arrays 253*a*, 253*c*, 253*e*) in the second image recording process. Accordingly, it is possible to further suppress the increase in the radiation intensity caused by the superimposition of the ultraviolet rays, and it is possible to further suppress the damage on the surface of the recording medium 10.

Modified Embodiments

Preferred embodiments of the present disclosure have been explained above. However, the present disclosure is not limited to these exemplary embodiments. It is possible to make various changes within a scope as defined in claims.

In the embodiment described above, the control unit 8 judges in which mode of the first recording mode and the second recording mode the image recording is performed, according to the difference d between the maximum value ra and the minimum value rb of the distance r acquired on the basis of the shape data of the recording medium 10 received by the data receiving unit such as the control panel 6 and the USB interface 70. However, the control unit 8 may judge in which mode of the first recording mode and the second recording mode the image recording is performed, on the basis of the data to instruct any one of the first image recording process and the second image recording process as received by the data receiving unit. Accordingly, it is possible to reflect the intention of the user in relation to the execution of the image recording by using any one of the first recording mode and the second recording mode.

In the first embodiment described above, in the second image recording process, the ultraviolet rays are radiated from only the lamp chip arrays 53*a*, 53*c*, 53*e* during the outward movement of the carriage 41, and the ultraviolet rays are radiated from only the lamp chip arrays 53*b*, 53*d* during the homeward movement. However, during the outward movement of the carriage 41, the ultraviolet rays may be radiated at the first light emission intensity from the lamp chip arrays 53*a*, 53*c*, 53*e*, and the ultraviolet rays may be radiated at the second light emission intensity smaller than the first light emission intensity from the lamp chip arrays 53*b*, 53*d*. In this case, during the homeward movement of the carriage 41, the ultraviolet rays are radiated at the first light emission intensity from the lamp chip arrays 53*b*, 53*d*, and the ultraviolet rays are radiated at the second light emission intensity from the lamp chip arrays 53*a*, 53*c*, 53*e*.

In the first embodiment described above, in the second image recording process, at least two first light source arrays are provided, and one second light source array is allowed to exist between the two adjoining first light source arrays. However, in the second image recording process, at least two first light source arrays are provided, and two or more second light source arrays may be allowed to exist between the two adjoining first light source arrays. Further, in the third embodiment, two or more third light source arrays may be allowed to exist between the two fourth light source arrays.

In the second embodiment described above, the interval changing mechanism 90 has the spring portion 91, the spring fixing portion 92, the wedge portion 93, and the wedge portion movement mechanism 94. However, the interval changing mechanism 90 may be any mechanism provided that the intervals in the left-right direction (scanning direction) between the adjoining lamp chip arrays 153 are changed. For example, the interval changing mechanism 90 may have a linear guide extending in the left-right direction and a ball screw. In this case, the lamp chip arrays 153 are attached to the linear guide. The lamp chip arrays 153, which are attached to the linear guide, are moved in the left-right direction by means of an unillustrated motor. Thus, the intervals in the left-right direction between the adjoining lamp chip arrays 153 are changed.

In the second embodiment and the third embodiment described above, the ultraviolet rays are radiated at the same light emission intensity from all of the lamp chip arrays 153 (253) of the radiation head 143 (243) in the second image recording process. However, the light emission intensity of the ultraviolet ray to be radiated may differ for each of the lamp chip arrays. In this case, the light emission intensities are set so that, in the passing area W, the difference between the maximum radiation intensity (the first maximum radiation intensity) of the ultraviolet ray radiated onto the first area Fa at which the distance r has the maximum value ra and the maximum radiation intensity (the second maximum radiation intensity) of the ultraviolet ray radiated onto the second area Fb at which the distance r has the minimum value rb is not more than the predetermined value P.

In the embodiment described above, the printer 1 is the serial printer on which the ink-jet head 42 and the radiation head 43 are carried, and the printer 1 includes the carriage 41 which is reciprocatively movable in the scanning direction. However, the printer 1 may be a line head printer comprising a fixed ink-jet head which has a length equivalent to or not less than the width in the scanning direction of the recording medium 10, and a radiation head which is fixed on the upstream side or the down streamside of the ink-jet head in the conveying direction, wherein inks are discharged from the fixed ink-jet head while conveying the recording medium 10 in the conveying direction, and the ultraviolet ray is radiated from the radiation head to thereby record an image. Note that in this case, a conveying mechanism for conveying the recording medium 10 corresponds to the movement mechanism of the present disclosure.

In the embodiment described above, it is also allowable that the control unit 8 can control the timing to discharge the inks from nozzles 46 of the ink-jet head 42 by using a waveform signal. In this case, the control unit 8 controls the waveform signal in the second image recording process, depending on the distance r in the upward-downward direction from the predetermined range in the passing area W to the lower surface of the radiation head 43. Specifically, if the distance r is large, the waveform signal is controlled to continuously discharge the inks. By doing so, the inks, which are continuously discharged, are combined with each other, the inks are accelerated thereby, and thus it is possible to allow the inks to fly farther. Therefore, the image recording can be appropriately performed even at any portion at which the distance r is large.

In the embodiment described above, the printer has been explained, which uses the ultraviolet curable ink that is curable by being irradiated with the ultraviolet ray. However, the ink is not limited to the ultraviolet curable ink, which may be any photocurable ink. Further, there is no limitation to the ink. It is also allowable to use any photocurable liquid.

Note that all of the embodiments and the modified embodiments described above may be combined with each other unless they mutually exclude their combination partners. For example, in the first embodiment described above, in the second image recording process, the light (ultraviolet ray) is radiated in a state in which only the mutual light emission intensity relationship among the plurality of light sources is different from that in the first image recording process. In the second embodiment and the third embodiment described above, in the second image recording process, the light is radiated in a state in which only the mutual positional relationship among the plurality of light sources is different from that in the first image recording process. However, the present disclosure is not limited to these exemplary embodiments. It is possible in the second image recording process to radiate the light in a state in which both the mutual positional relationship among the plurality of light sources and the mutual light emission intensity relationship among the plurality of light sources are different from those in the first image recording process.

EXAMPLE

In the next place, the radiation intensities ($W/cm^2$) of ultraviolet rays radiated onto surfaces of respective recording media A and B were measured when the image recording was performed in the first recording mode as performed in the first embodiment described above (Comparative Example) and when the image recording was performed in the second recording mode (Example), in relation to the respective two types of recording media A and B which have different distances in the upward-downward direction from the surfaces to the radiation head 43.

The lengths in the front-back direction and the left-right direction of the recording medium 110*a* are the same as those of the recording medium 110*b*, and the material of the recording medium 110*a* is the same as that of the recording medium 110*b* as well. The recording medium 110*a* has a flat plate-shaped surface, and the distance in the upward-downward direction from the surface to the lower surface of the radiation head 43 is 2 mm when the recording medium 110*a* is placed on the upper surface of the platen 2. The recording medium 110*b* has a flat plate-shaped surface, and the distance in the upward-downward direction from the surface to the lower surface of the radiation head 43 is 15 mm when the recording medium 110*b* is placed on the upper surface of the platen 2.

Figure 9:
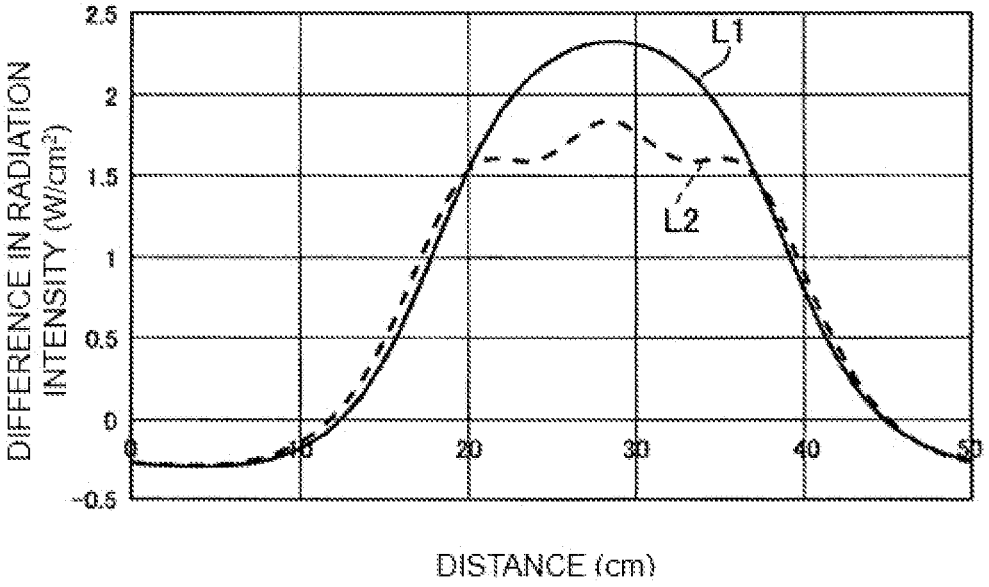
FIG. 9 shows a graph illustrating the difference in the radiation intensity of the ultraviolet ray radiated onto the surface of the recording medium concerning Comparative Example and Example.
Figure 10:
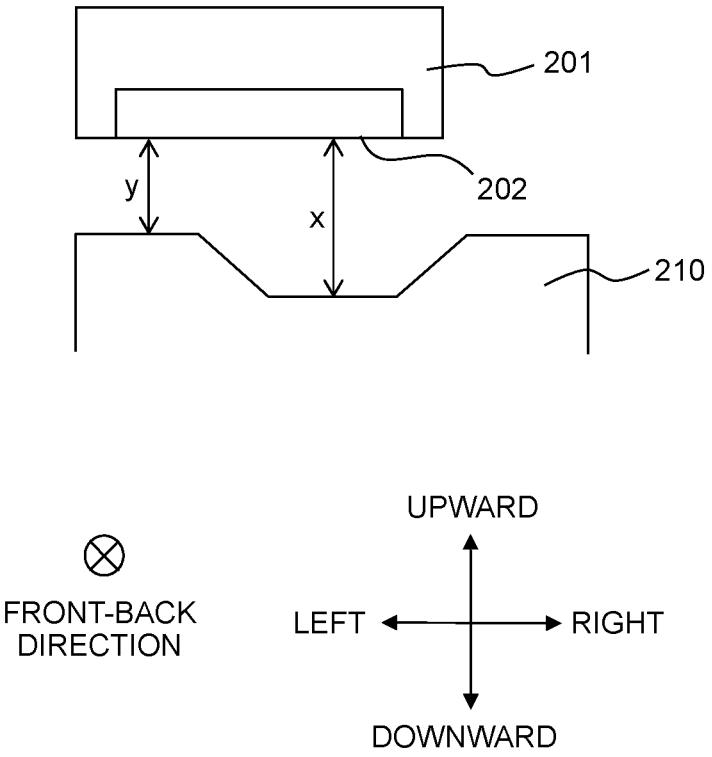
FIG. 10 shows a situation in which an ultraviolet radiation device and a recording medium are arranged opposingly in relation to a conventional printer.

The horizontal axis of FIG. 9 represents the distance in the left-right direction from the left end of the recording medium 110*a*, 110*b*. "0 (zero)" indicates the left end of the recording medium 110*a*, 110*b*, and "50" indicates the right end of the recording medium 110*a*, 110*b*. The vertical axis of FIG. 9 represents the difference ($W/cm^2$) between the radiation intensity of the ultraviolet ray radiated onto the surface of the recording medium 110*a* and the radiation intensity of the ultraviolet ray radiated onto the surface of the recording medium 110*b*.

The solid line L1 shown in FIG. 9 (Comparative Example) indicates a case in which the image recording is performed in the first recording mode as follows. The image recording was performed in the first recording mode on the recording medium 110*a* and the image recording was performed in the first recording mode on the recording medium 110*b*. The solid line L1 indicates the difference between the radiation intensity of the ultraviolet ray radiated onto the surface of the recording media 110*a* and that of 110*b*. In this case, the light emission intensities of the ultraviolet rays of all of the lamp chips 48 of the radiation head 43 had the values required to cure the inks landed on the surfaces of the recording medium 110*a* and the recording medium 110*b*, wherein the value, which was provided when the ultraviolet ray was radiated onto the recording medium 110*a*, was the same as the value which was provided when the ultraviolet ray was radiated onto the recording medium 110*b*.

The chain line L2 shown in FIG. 9 (Example) indicates a case in which the image recording is performed in the second recording mode as follows. The image recording was performed in the second recording mode on the recording medium 110*a* and the image recording was performed in the second recording mode on the recording medium 110*b*. The solid line L2 indicates the difference between the radiation intensity of the ultraviolet ray radiated onto the surface of the recording media 110*a* and that of 110*b*. In this case, the light emission intensities of the ultraviolet rays of the lamp chip arrays 53 as the first light source arrays of the radiation head 43 had the values required to cure the inks landed on the surfaces of the recording medium 110*a* and the recording medium 110*b*, wherein the value, which was provided when the ultraviolet ray was radiated onto the recording medium 110*a*, was the same as the value which was provided when the ultraviolet ray was radiated onto the recording medium 110*b*. Further, the light emission intensity of the ultraviolet ray in the second recording mode was larger than the light emission intensity of the ultraviolet ray in the first recording mode.

According to FIG. 9, the maximum value of the difference in the radiation intensity is decreased especially in the vicinity of the center of the recording medium when the image recording is performed in the second recording mode (L2) as compared with when the image recording is performed in the first recording mode (L1). In this context, in Comparative Example (L1) and Example (L2), the difference in the radiation intensity between the recording medium 110*a* and the recording medium 110*b* is measured when the ultraviolet ray radiation is performed at the same light emission intensity to the two recording media 110*a*, 110*b* in which the distance from the surface to the lower surface of the radiation head 43 differs and the shape and the material as other factors are identical with each other. That is, it is affirmed that the difference in the intensity obtained in Comparative Example and Example indicates, in a suspected manner, the difference in the radiation intensity of the ultraviolet ray, which may be brought about in the recording medium having the concave/convex shape at any arbitrary position on the surface. Therefore, it is considered that the damage caused by the ultraviolet ray radiation onto the recording medium can be suppressed by performing the image recording in the second recording mode when the image recording is performed by using the photocurable ink on the recording medium having the concave/convex surface.

What is claimed is:

1. A liquid discharge apparatus for recording an image on a surface of a recording medium, the liquid discharge apparatus comprising:

a head which has a nozzle surface having a plurality of nozzles and which is configured to discharge a photocurable liquid from the plurality of nozzles;

a radiation unit which has a plurality of light sources and which is configured to radiate light from the light sources to cure the liquid;

a movement mechanism which is configured to move the recording medium or both of the head and the radiation unit in a direction parallel to the nozzle surface; and a controller configured to:

select one of a first recording mode and a second recording mode, the first recording mode being selected under a condition that a difference between a maximum value and a minimum value of a radiation distance is less than a predetermined length, the second recording mode being selected under a condition that the difference is not less than the predetermined length, and the radiation distance being a distance in a first direction orthogonal to the nozzle surface from a predetermined range on a surface of the recording medium to the radiation unit;

control the head, the radiation unit, and the movement mechanism to execute a first image recording process under a condition that the first recording mode is selected; and control the head, the radiation unit, and the movement mechanism to execute a second image recording process under a condition that the second recording mode is selected, wherein the first image recording process includes:

discharging the liquid from at least one of the plurality of nozzles to the predetermined range while moving the recording medium or both of the head and the radiation unit; and radiating the light from the plurality of light sources onto the liquid landed onto the predetermined range, and the second image recording process includes:

discharging the liquid from at least one of the plurality of nozzles to the predetermined range while moving the recording medium or both of the head and the radiation unit; and radiating the light from the plurality of light sources onto the liquid landed onto the predetermined range in a state in which a mutual positional relationship among the plurality of light sources or a mutual light emission intensity relationship among the plurality of light sources is different from that in the first image recording process, so that a difference between a first maximum radiation intensity and a second maximum radiation intensity is not more than a predetermined value, the first maximum radiation intensity being a maximum radiation intensity of the light radiated onto a first area, in the predetermined range, at which the radiation distance has the maximum value, and the second maximum radiation intensity being a maximum radiation intensity of the light radiated onto a second area, in the predetermined range, at which the radiation distance has the minimum value.

2. The liquid discharge apparatus according to claim 1, wherein:

a plurality of light source rows are arranged in a second direction orthogonal to the first direction, and each of the plurality of light source rows includes the plurality of light sources aligned in a third direction orthogonal to the first direction and the second direction; and in the second image recording process, the controller is configured to:

control the radiation unit to radiate the light at a first light emission intensity from at least one first light source row selected from the plurality of light source rows; and control the radiation unit either to radiate the light at a second light emission intensity smaller than the first light emission intensity from at least one second light source row selected from the plurality of light source rows, or not to radiate the light from the at least one second light source row.

3. The liquid discharge apparatus according to claim 2, wherein in the second image recording process, the controller is configured to control the radiation unit to radiate the light at the second light emission intensity from the at least one second light source row.

4. The liquid discharge apparatus according to claim 2, wherein in the second image recording process, the controller is configured to control the radiation unit not to radiate the light from the at least one second light source row.

5. The liquid discharge apparatus according to claim 2, wherein the at least one first light source row includes two first light source rows, in the second image recording process, the controller is configured to control the radiation unit to select the two first light source rows between which in the second direction the at least one second light source row exists.

6. The liquid discharge apparatus according to claim 2, wherein in the first image recording process, the controller is configured to control the radiation unit to radiate the light at the same light emission intensity from all of the plurality of light source rows.

7. The liquid discharge apparatus according to claim 2, wherein:

the movement mechanism includes a carriage on which the head and the radiation unit are carried, the movement mechanism is configured to reciprocatively move the carriage in the second direction;

the liquid discharge apparatus further comprises a conveying mechanism which is configured to convey the recording medium in the third direction;

in the first image recording process and the second image recording process, the controller is configured to:

control the movement mechanism and the head to discharge the liquid to the predetermined range while moving the carriage in the second direction; and control the movement mechanism and the radiation unit to radiate the light onto the liquid landed onto the predetermined range while moving the carriage in the second direction, and the controller is further configured to:

control the conveying mechanism to convey the recording medium in the third direction after the first image recording process or the second image recording process; and control the movement mechanism, the head, the radiation unit, and the conveying mechanism to repeat the conveyance of the recording medium and one or more of the first image recording process or the second image recording process until the image recording is terminated on the recording medium.

8. The liquid discharge apparatus according to claim 7, wherein in the second image recording process, the controller is configured to:

control the radiation unit, during outward movement of the carriage, to select the at least one first light source row of the outward movement and the at least one second light source row of the outward movement; and control the radiation unit, during homeward movement of the carriage, to select the at least one first light source row of the homeward movement and the at least one second light source row of the homeward movement, wherein the at least one first light source row of the outward movement is identical to the at least one second light source row of the homeward movement, and the at least one second light source row of the outward movement is identical to the at least one first light source row of the homeward movement.

9. The liquid discharge apparatus according to claim 1, wherein:

a plurality of light source rows are arranged in a second direction orthogonal to the first direction, and each of the plurality of light source rows includes the plurality of light sources aligned in a third direction orthogonal to the first direction and the second direction;

the liquid discharge apparatus further comprises an interval changing mechanism which is configured to change an interval in the second direction between adjoining light source rows among the plurality of light source rows; and in the second image recording process, the controller is configured to control the interval changing mechanism to increase the interval in second direction between the adjoining light source rows as compared with that in the first image recording process.

10. The liquid discharge apparatus according to claim 9, wherein in the first image recording process and the second image recording process, the controller is configured to control the radiation unit to radiate the light at the same light emission intensity from all of the plurality of light source rows.

11. The liquid discharge apparatus according to claim 9, wherein:

the movement mechanism includes a carriage on which the head and the radiation unit are carried, the movement mechanism is configured to reciprocatively move the carriage in the second direction;

the liquid discharge apparatus further comprises a conveying mechanism which is configured to convey the recording medium in the third direction;

in the first image recording process and the second image recording process, the controller is configured to:

control the movement mechanism and the head to discharge the liquid to the predetermined range while moving the carriage in the second direction; and control the movement mechanism and the radiation unit to radiate the light onto the liquid landed onto the predetermined range while moving the carriage in the second direction, and the controller is further configured to:

control the conveying mechanism to convey the recording medium in the third direction after the first image recording process or the second image recording process; and control the movement mechanism, the head, the radiation unit, and the conveying mechanism to repeat the conveyance of the recording medium and one or more of the first image recording process or the second image recording process until the image recording is terminated on the recording medium.

12. The liquid discharge apparatus according to claim 1, wherein:

a plurality of light source rows are arranged in a second direction orthogonal to the first direction, and each of the plurality of light source rows includes the plurality of light sources aligned in a third direction orthogonal to the first direction and the second direction;

the plurality of light source rows includes at least one third light source row and at least one fourth light source row;

the liquid discharge apparatus further comprises a position changing mechanism which configured to change a position in the first direction of the third light source row; and in the second image recording process, the controller is configured to control the position changing mechanism to distance the position in the first direction of the third light source row from the recording medium as compared with that in the first image recording process.

13. The liquid discharge apparatus according to claim 12, wherein the at least one fourth light source row includes two fourth light source rows between which in the second direction the at least one third light source row exists.

14. The liquid discharge apparatus according to claim 12, wherein in the first image recording process, the controller is configured to control the position changing mechanism to position the third light source row at the same position in the first direction as the fourth light source row.

15. The liquid discharge apparatus according to claim 12, wherein in the first image recording process and the second image recording process, the controller is configured to control the radiation unit to radiate the light at the same light emission intensity from all of the plurality of light source rows.

16. The liquid discharge apparatus according to claim 12, wherein:

the movement mechanism includes a carriage on which the head and the radiation unit are carried, the movement mechanism is configured to reciprocatively move the carriage in the second direction;

the liquid discharge apparatus further comprises a conveying mechanism which is configured to convey the recording medium in the third direction;

in the first image recording process and the second image recording process, the controller is configured to:

control the movement mechanism and the head to discharge the liquid to the predetermined range while moving the carriage in the second direction; and control the movement mechanism and the radiation unit to radiate the light onto the liquid landed onto the predetermined range while moving the carriage in the second direction, and the controller is further configured to:

control the conveying mechanism to convey the recording medium in the third direction after the first image recording process or the second image recording process; and control the movement mechanism, the head, the radiation unit, and the conveying mechanism to repeat the conveyance of the recording medium and one or more of the first image recording process or the second image recording process until the image recording is terminated on the recording medium.

17. The liquid discharge apparatus according to claim 1, wherein:

the liquid discharge apparatus further comprises a data receiving unit; and in a case of selecting the recording mode, the controller is configured to:

calculate the difference between the maximum value and the minimum value of the radiation distance on the basis of the shape data of the recording medium received by the data receiving unit; and select one of the first recording mode and the second recording mode on the basis of the calculated difference.

18. The liquid discharge apparatus according to claim 1, wherein:

the liquid discharge apparatus further comprises a data receiving unit; and in a case of selecting the recording mode, the controller is configured to select one of the first recording mode and the second recording mode on the basis of data, received by the data receiving unit, to indicate the first image recording process or the second image recording process.

19. The liquid discharge apparatus according to claim 1, wherein:

the movement mechanism is configured to move the recording medium in the direction parallel to the nozzle surface; and in the first image recording process and the second image recording process, the controller is configured to control the movement mechanism and the head to discharge the liquid from at least one of the plurality of nozzles to the predetermined range while moving the recording medium.

* * * * *